US011289008B2

(12) United States Patent
Chen et al.

(10) Patent No.: US 11,289,008 B2
(45) Date of Patent: Mar. 29, 2022

(54) PIXEL CIRCUIT

(71) Applicant: AU Optronics Corporation, Hsin-Chu (TW)

(72) Inventors: Yi-Chiung Chen, Hsin-Chu (TW); Mao-Hsun Cheng, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 186 days.

(21) Appl. No.: 16/734,455

(22) Filed: Jan. 6, 2020

(65) Prior Publication Data

US 2020/0243001 A1 Jul. 30, 2020

(30) Foreign Application Priority Data

Jan. 29, 2019 (TW) ..... 108103363

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2300/0819* (2013.01); *G09G 2300/0842* (2013.01); *G09G 2300/0861* (2013.01); *G09G 2310/0267* (2013.01); *G09G 2310/08* (2013.01); *G09G 2320/0233* (2013.01); *G09G 2320/0247* (2013.01); *G09G 2320/0257* (2013.01); *G09G 2320/045* (2013.01)

(58) Field of Classification Search
CPC ..... G09G 3/32; G09G 2310/08; G09G 2300/0819; G09G 2300/0842; G09G 2310/0267; G09G 2300/0861; G09G 2320/045; G09G 3/3233; G09G 2320/02
See application file for complete search history.

(56) References Cited

U.S. PATENT DOCUMENTS

2009/0102829 A1 4/2009 Abe et al.
2016/0055791 A1* 2/2016 Kishi ..... G09G 3/30 345/212
2018/0174513 A1* 6/2018 Lee ..... G09G 3/3233
2019/0295473 A1* 9/2019 Lu ..... G09G 3/3266

FOREIGN PATENT DOCUMENTS

CN 101793370 A 8/2010
CN 106531077 A 3/2017

* cited by examiner

*Primary Examiner* — Amr A Awad
*Assistant Examiner* — Maheen I Javed
(74) *Attorney, Agent, or Firm* — WPAT, PC

(57) ABSTRACT

A pixel circuit is disclosed herein, which includes a first switch, a capacitor, a driving transistor, and a light-emitting diode (LED). The first switch outputs voltage data in response to a scan signal. A first terminal of the capacitor and the first switch are coupled to a node. A second terminal of the capacitor receives a reference signal. The driving transistor is coupled to the node, and configured to output current according to a voltage stored in the node. The LED is coupled to the driving transistor, and emits light according to the current. The reference voltage is different during different operation periods. The driving transistor outputs a first current according to the voltage data and the voltage difference, and outputs a second current according to the voltage data during different operation periods, such that the LED emits a first light and a second light during different operation periods.

15 Claims, 12 Drawing Sheets

PIXEL CIRCUIT

RELATED APPLICATIONS

This application claims priority to Taiwan Application Serial Number 108103363, filed Jan. 29, 2019, which is herein incorporated by reference in its entirety.

BACKGROUND

Field of Invention

The present of the disclosure relates to a display device. More particularly, the present disclosure relates to a pixel circuit of a display device.

Description of Related Art

With the advance of technology, consumers are increasingly demanding the quality of display devices. Under this requirement, when a display device wants to display a target brightness during a frame time, in general, to provide a normal driving current of a light-emitting element (such as a light-emitting diode) and a long emission ratio in order to cause the human eye to generate a brightness integral to sense a perceived target brightness. However, in this driving mode, the response time of the light-emitting element reaching the target brightness is long, and consumers may easily experience the phenomenon of motion blur. The shorter the driving current given to the light-emitting element, the shorter the reaction time for the light-emitting element to reach the target brightness. However, when driven by a large current, the display device must be adjusted to have a lower illumination ratio in a frame time to maintain the same target brightness sensed by the human eye. If the illumination ratio has a time frame which is too low, the human eye will easily notice that the display device is flickering.

It can be seen that the above existing methods obviously have inconveniences and defects, and need to be improved. In order to solve the above problems, the relevant fields have tried their best to find a solution, but for a long time, no suitable solution has been developed.

SUMMARY

One aspect of the present disclosure is a pixel circuit. The pixel circuit includes a first switch, a capacitor, a driving transistor, a driving transistor and a light-emitting diode (LED). The first switch is configured to output a data voltage in response to a scan signal. A first terminal of the capacitor and the first switch are coupled to a node, a second terminal of the capacitor is configured to receive a reference signal. The driving transistor is coupled to the node, the driving transistor outputs a current according to a voltage of the node. The LED is coupled to the driving transistor, the LED emits light according to the current. The data voltage is written to the node by the first switch, the reference signal is changed to different voltages during different operation periods, the capacitor couples a voltage difference between the different voltages to the node according to the reference signal, the driving transistor outputs a first current respectively according to the data voltage and the voltage difference, and outputs a second current according to the data voltage during different operation periods, such that the LED emits a first brightness light according to the first current and emits a second brightness light according to the second current during different operation periods.

Another aspect of the present disclosure is a pixel circuit. The pixel circuit includes a first switch, a capacitor, a driving transistor and a light emitting diode (LED). A first terminal of the capacitor and the first switch are coupled to a node, a second terminal of the capacitor is configured to receive a reference signal. The driving transistor is coupled to the node, the driving transistor outputs a current according to a voltage of the node. The LED is coupled to the driving transistor, the LED emits light according to the current. In a first period, the first switch outputs a data voltage to the node in response to a scan signal, and the reference voltage comprises a first voltage, in a second period, the reference signal comprises a second voltage, the driving transistor outputs a first current to the LED according to the voltage of the node, in a third period, the reference signal comprises the first voltage, the driving transistor outputs a second current to the LED according to the voltage of the node.

Therefore, according to the technical content of the present disclosure, the embodiment of the present disclosure provides a pixel circuit. The different current is provided by the adjustment of the reference signal under the same data voltage. Once the pixel circuit provides a large current by the above technical features, the response time can be shortened, and the field of the pixel circuit application of the present disclosure becomes wider. When the pixel circuit provides a small current by the above technical features, a longer illumination ratio can be maintained for a frame time to make the display uninterrupted, and the phenomenon of display flicker can be reduced.

DETAILED DESCRIPTION

Figure 1:
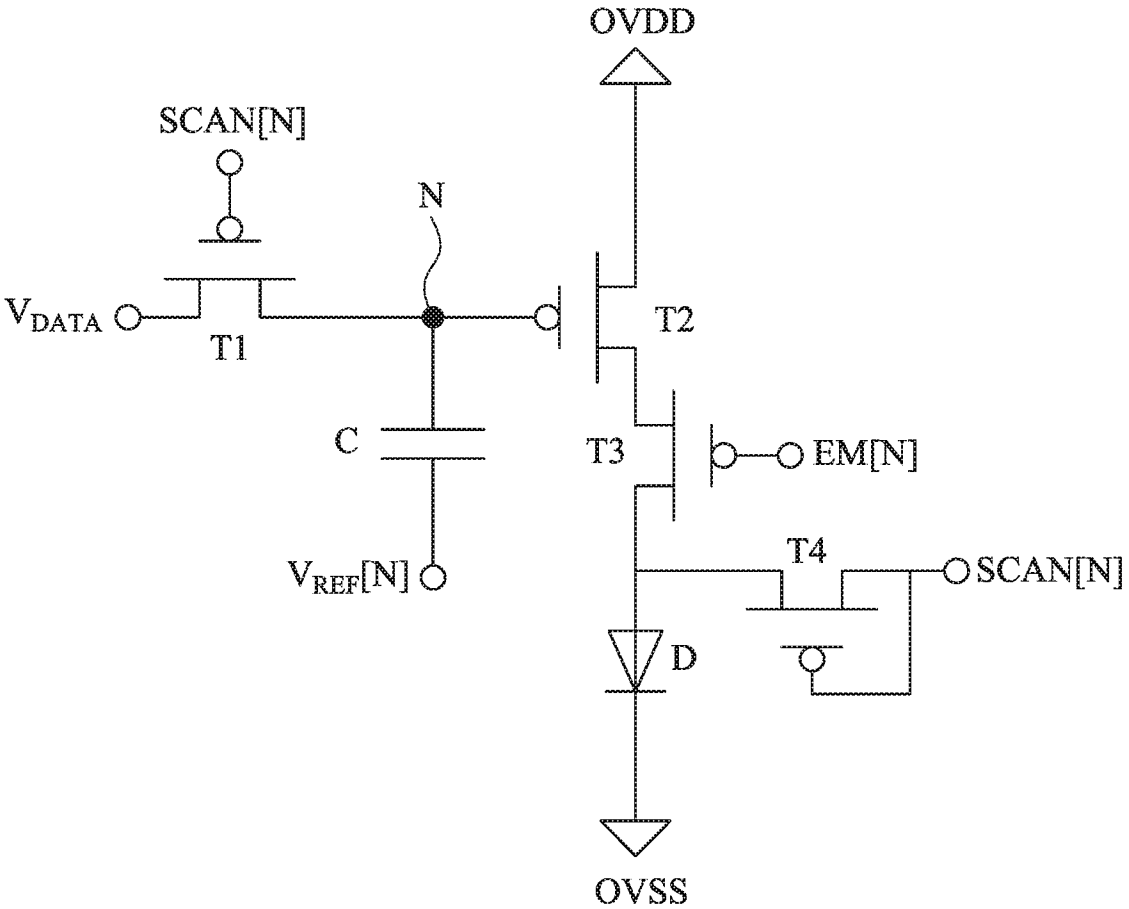
FIG. 1 is a schematic diagram of a pixel circuit according to an embodiment of the present disclosure.

The following is a detailed description of the embodiments in order to provide a better understanding of the scope of the present invention, but the embodiments are not intended to limit the scope of the disclosure, and the description of the structural operation is not limited. The order in which they are performed, any structure that is recombined by the elements, produces equal means of function, and is covered by the disclosure. In addition, according to industry standards and practices, the drawings are only for the purpose of auxiliary explanation, and are not drawn according to the original size. In fact, the dimensions of various features can be arbitrarily increased or decreased for explanation. In the following description, the same elements will be denoted by the same reference numerals for convenience of understanding.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

Referring to FIG. 1, FIG. 1 is a schematic diagram of a pixel circuit according to an embodiment of the present disclosure. As shown in FIG. 1, the pixel circuit includes a switch T1, a driving transistor T2, a switch T3, a switch T4, a capacitor C and a LED D. On the connection relationship, one terminal of the switch T1, a first terminal of the capacitor C and a control terminal of the driving transistor T2 are coupled to a node N. The LED D is coupled to one terminal of the driving transistor T2 by the switch T3. The switch T4 is coupled to the LED D.

One terminal of the switch T1 is configured to a data voltage $V_{DATA}$, the control terminal of the switch is configured to receive a scan signal SCAN[N], thus, the switch T1 outputs the data voltage $V_{DATA}$ to the node N in response to the scan signal SCAN[N]. The second terminal of the capacitor C is configured to receive a reference signal $V_{REF}$[N]. One terminal of the driving transistor T2 is configured to receive a power supply voltage OVDD, and determine the magnitude of an output current according to the voltage of the node N. The LED D emits light according to the current outputted from the driving transistor T2. The switch T3 is configured to determine whether to conduct a current path passing through LED D according to the control signal EM[N]. In addition, the switch T4 determines whether to reset a voltage of an anode of the LED D according to scan signal SCAN[N]. A cathode of the LED D is configured to receive a power supply voltage OVSS. In an embodiment, the power supply voltage OVSS is a low voltage or a ground voltage.

Figure 2:
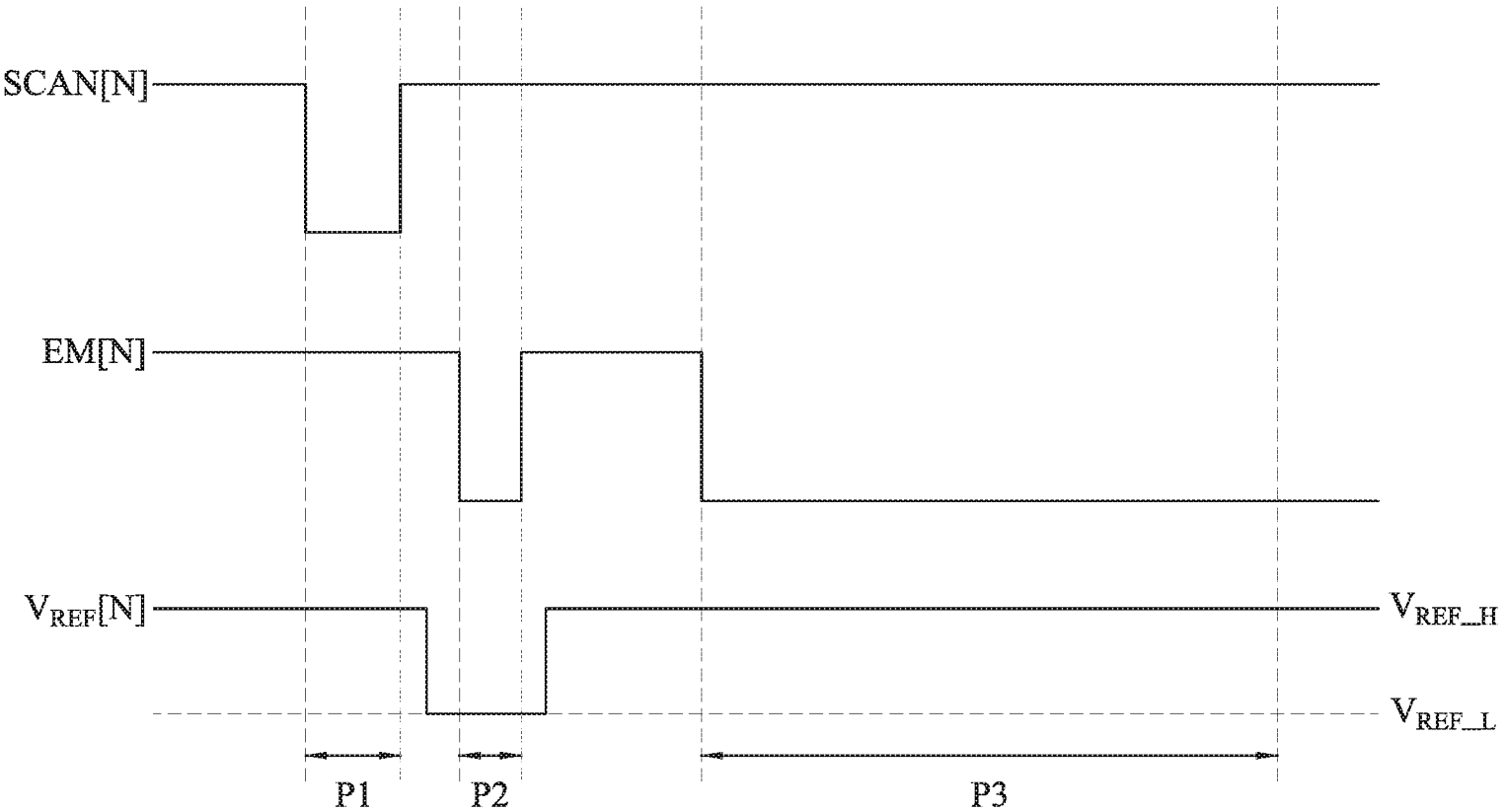
FIG. 2 is a waveform schematic diagram according to an embodiment of the present disclosure.

FIG. 2 is a waveform schematic diagram according to an embodiment of the present disclosure. Referring to FIG. 2 to understand the overall operation of the pixel circuit shown in FIG. 1 of the present disclosure. In a first period P1, the scan[N] is a low level signal, the control signal EM[N] and the reference signal $V_{REF}$[N] are a high level signal. In this time, the switch T1 and the switch T4 is turned on according to the low level of the scan signal SCAN[N]. The switch T3 is turned off according to the high level of the control signal EM[N].

Figure 3:
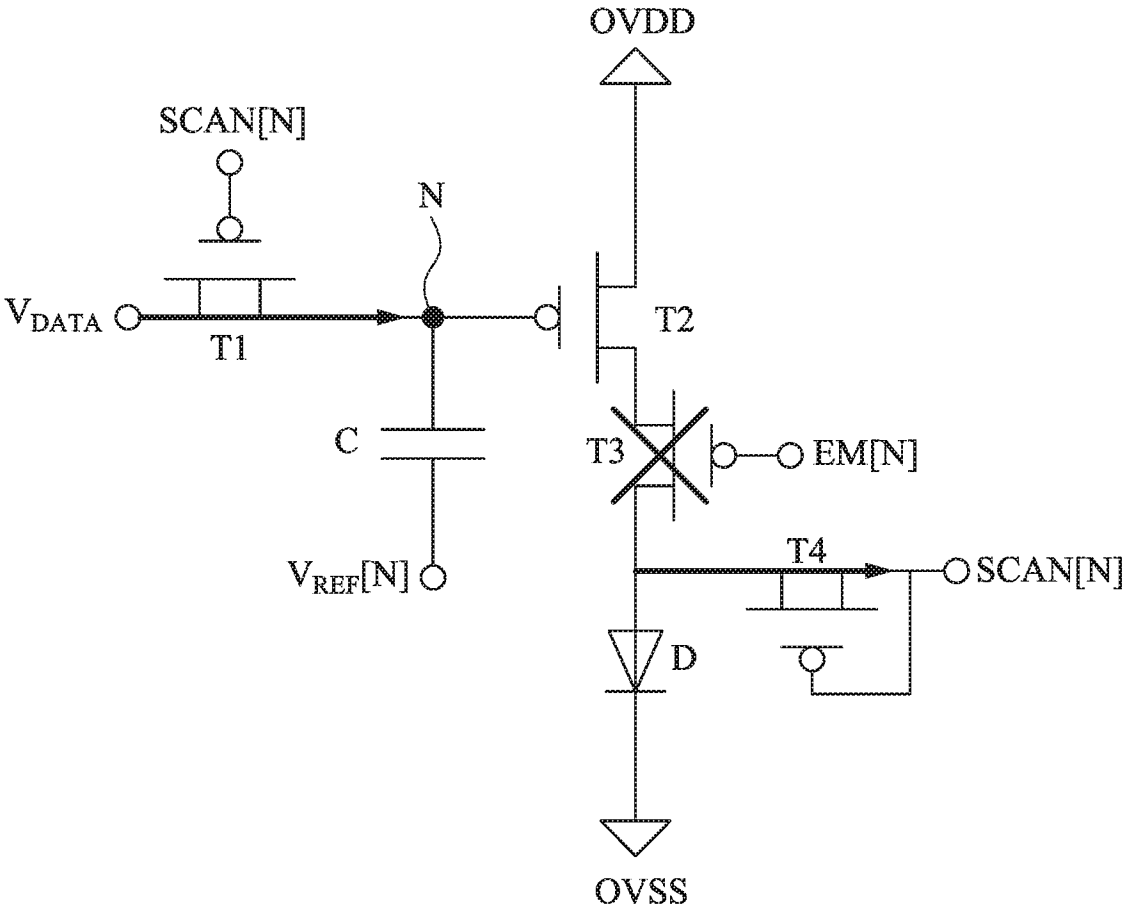
FIG. 3 is an operation schematic diagram of a pixel circuit as shown in FIG. 1 according to an embodiment of the present disclosure.

The operation method of the pixel circuit in the first period P1 is shown in FIG. 3, FIG. 3 is an operation schematic diagram of a pixel circuit as shown in FIG. 1 according to an embodiment of the present disclosure. As shown in FIG. 3, the switch T1 outputs the data voltage $V_{DATA}$ to the node N, the data voltage $V_{DATA}$ is stored by the capacitor C. The switch T4 resets the voltage of the anode of the LED D. In addition, since the switch T3 is turned off, the current is not supplied to the LED D at this time.

Referring to FIG. 2, in a period P2, the scan signal SCAN[N] is a high level signal, the control signal EM[N] and the reference signal $V_{REF}$[N] is a low level signal. At this time, the switch T1 and the switch T4 are turned off according to the high level of the scan signal SCAN[N], the switch T3 is turned on according to the low level of the control signal EM[N].

Figure 4:
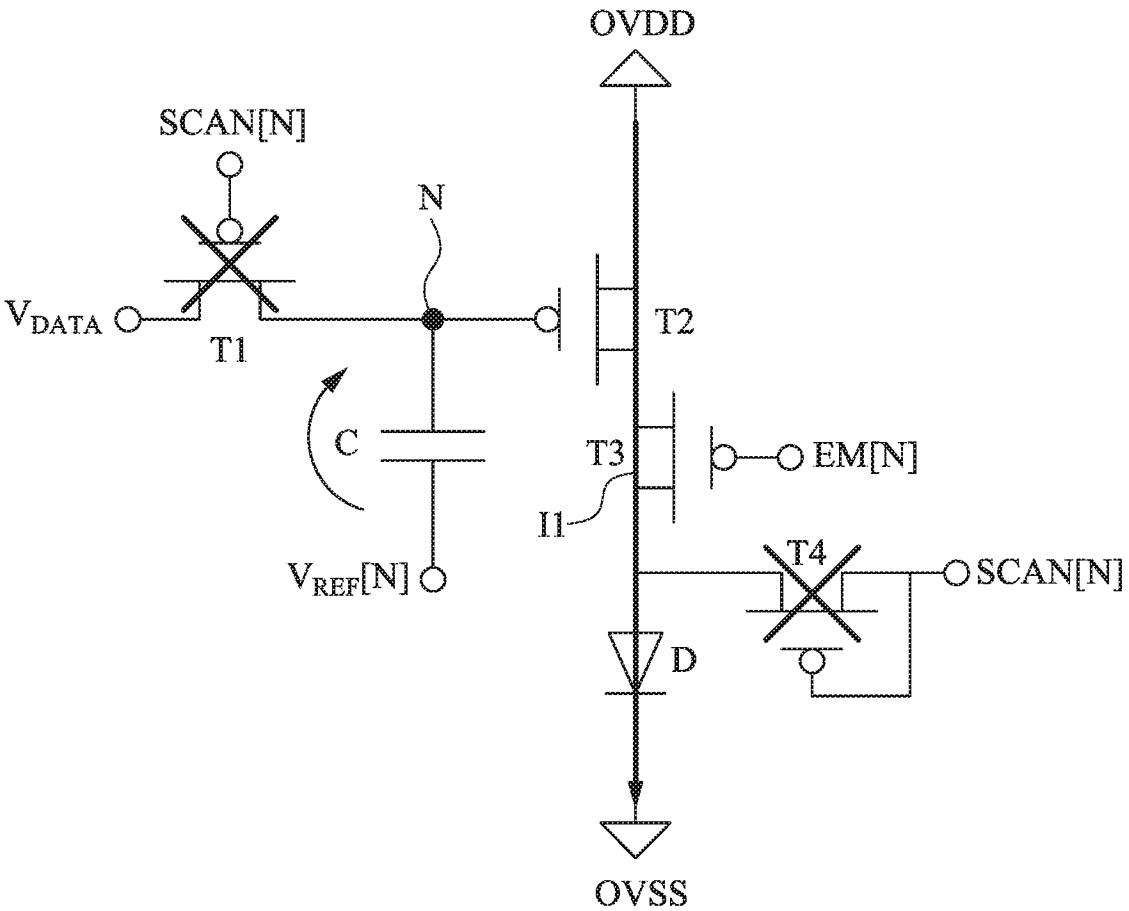
FIG. 4 is an operation schematic diagram of a pixel circuit as shown in FIG. 1 according to an embodiment of the present disclosure.

The operation method of the pixel circuit in the second period P2 is shown in FIG. 4, FIG. 4 is an operation schematic diagram of a pixel circuit as shown in FIG. 1 according to an embodiment of the present disclosure. As shown in FIG. 4, the switch T1 is turned off to stop outputting the data voltage $V_{DATA}$ to the node N. The reference signal $V_{REF}$[N] is received by the second terminal of the capacitor C is changed from a first voltage $V_{REF_H}$ of the first period P1 to a second voltage $V_{REF_L}$ of the second period P2. At this time, a voltage difference between the first voltage $V_{REF_H}$ and the second voltage $V_{REF_L}$ is coupled to node N, such that a voltage stored in node N is changed to the data voltage $V_{DATA}$ and the above voltage difference. In an embodiment, the first voltage $V_{REF_H}$ is greater the second voltage $V_{REF_L}$. The voltage $V_{node}$ stored in node N can be expressed by the following formula 1:

$$V_{node}=V_{DATA}-(V_{REF_H}-V_{REF_L})$$

Referring to FIG. 4, the switch T3 is turned on according to the low level of the control signal EM[N], the driving transistor T2 outputs a first current I1 to the LED D by the switch T3 according to the data voltage $V_{DATA}$ and a difference between the voltage difference, the LED D emits a first brightness light according to the first current I1. In an embodiment, the period during which switch T3 is turned on (that is, the period during which the above control signal EM[N] is a low level) partially overlaps the period during which the reference signal $V_{REF}$[N] is the second voltage $V_{REF_L}$. The current I1 can be expressed by the following formula 2:

$$I_{OLED}=K(V_{SG}-|V_{TH}|)^2$$

Taking the state of the driving transistor T2 in the second period P2 into the formula 2:

$$I_{OLED}==K(\text{OVDD}-(V_{DATA}-(V_{REF_H}-V_{REF_L}))-|V_{TH}|)^2$$

The current value of the current I1 can be obtained by arranging the above formula 3:

$$I_{OLED}=K(\text{OVDD}-V_{DATA}+V_{REF_H}-V_{REF_L}-|V_{TH}|)^2$$

As shown in formula 4, since the adjustment of the reference signal $V_{REF}$[N], and coupling the voltage difference between the first voltage $V_{REF_H}$ and the second voltage $V_{REF_L}$ to the node N, such that the first current I1 higher. In an embodiment, the second voltage $V_{REF_L}$ is a low voltage or a ground voltage, therefore, in formula 4, the voltage difference between the first voltage $V_{REF_H}$ and the second voltage $V_{REF_L}$ is increased. Accordingly, the first current I1 is relatively high, and the higher current can shorten the reaction time. The field of pixel circuit applications of the present disclosure is broader, for example, the pixel circuit is applicable to high resolution devices such as virtual reality (VR) devices.

Referring to FIG. 2, in a third period P3, the scan signal SCAN[N] and the reference signal $V_{REF}$[N] are the high level signals, the control signal is a low level signal. At this time, the switch T1 and switch T4 are turned off according to the high level of the scan signal SCAN[N], the switch T3 is turned on according to the low level of the EM[N].

Figure 5:
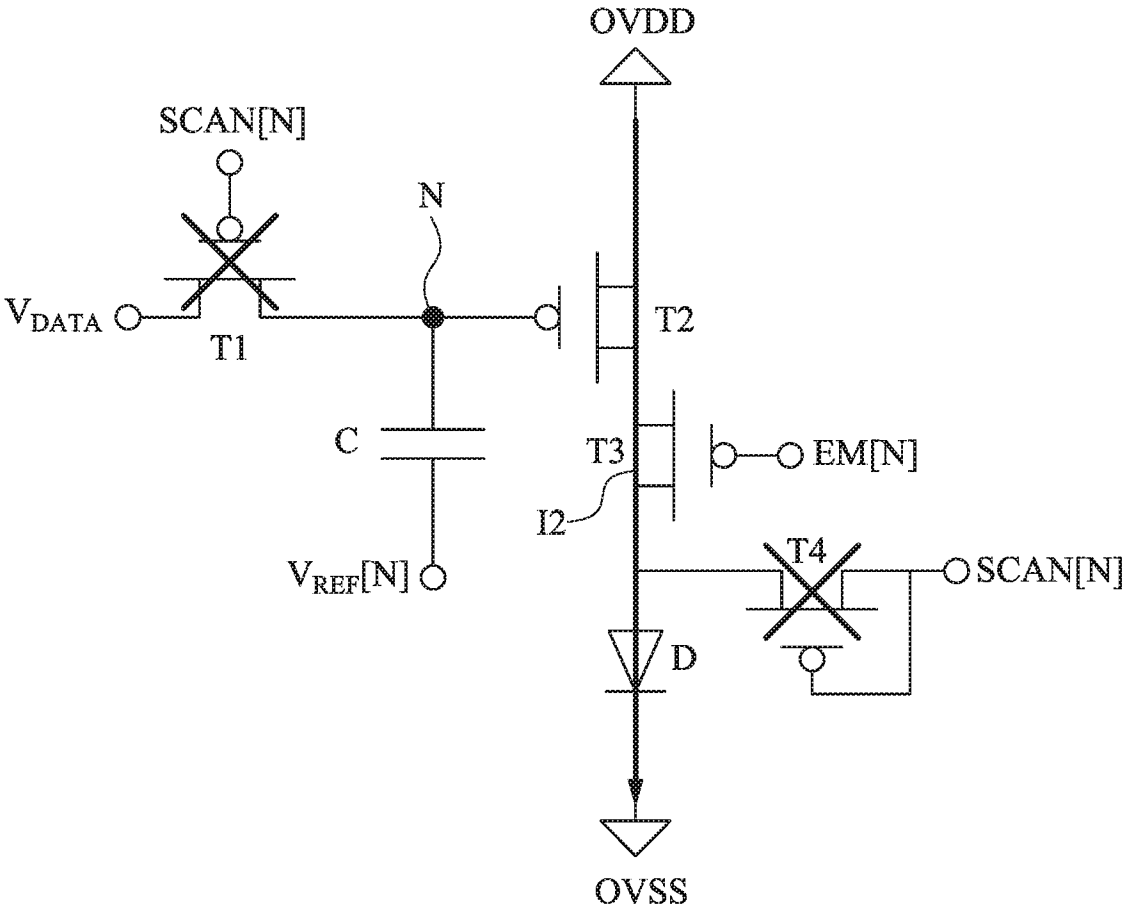
FIG. 5 is an operation schematic diagram of a pixel circuit as shown in FIG. 1 according to an embodiment of the present disclosure.

The operation method of the pixel circuit in the third period P3 is shown in FIG. 5, FIG. 5 is an operation schematic diagram of a pixel circuit as shown in FIG. 1 according to an embodiment of the present disclosure. As shown in FIG. 5, the switch T1 is turned off to stop outputting the data voltage $V_{DATA}$ to the node N. The reference voltage $V_{REF}$ received by the second terminal of the capacitor C is adjusted to the original first voltage $V_{REF_H}$, such that the voltage stored in node N is recovered to the data voltage $V_{DATA}$. Namely, the reference signal $V_{REF}$ received by the second terminal of the capacitor C in the first period P1 and the reference signal $V_{REF}$ received by the second terminal of the capacitor C in the third period P3 are the same. Accordingly, the voltages stored by the node N in the first period P1 and the third period P3 are also the same.

At this time, the switch T3 is turned on according to the low level of the control signal EM[N], the driving transistor T2 outputs a second current I2 to the LED D by the switch T3 according to the data voltage $V_{DATA}$, the LED D emits second brightness light according to the current I2. Taking the state of the driving transistor T2 in the third period P3 into the above formula 2, the following formula 5 can be obtained:

$$I_{OLED}=K(\mathrm{OVDD}-V_{DATA}-|V_{TH}|)^2$$

As shown in formula 5, since the reference signal $V_{REF}$ [N] is adjusted to the first voltage $V_{REF_H}$. Accordingly, the voltage stored in the node N is recovered to the data voltage $V_{DATA}$, at this time, the second current I2 compared to the first current I1 is correspondingly reduced. Accordingly, under the same data voltage $V_{DATA}$, different magnitudes of current by adjustment of the reference signal $V_{REF}$[N] are provided, for example, making the first current I1 greater than the second current I2. Therefore, when the pixel circuit provides a small current by the above technical features, it is possible to maintain a long illumination ratio in a frame time such that the display is uninterrupted, and the display flicker can be reduced.

Figure 6:
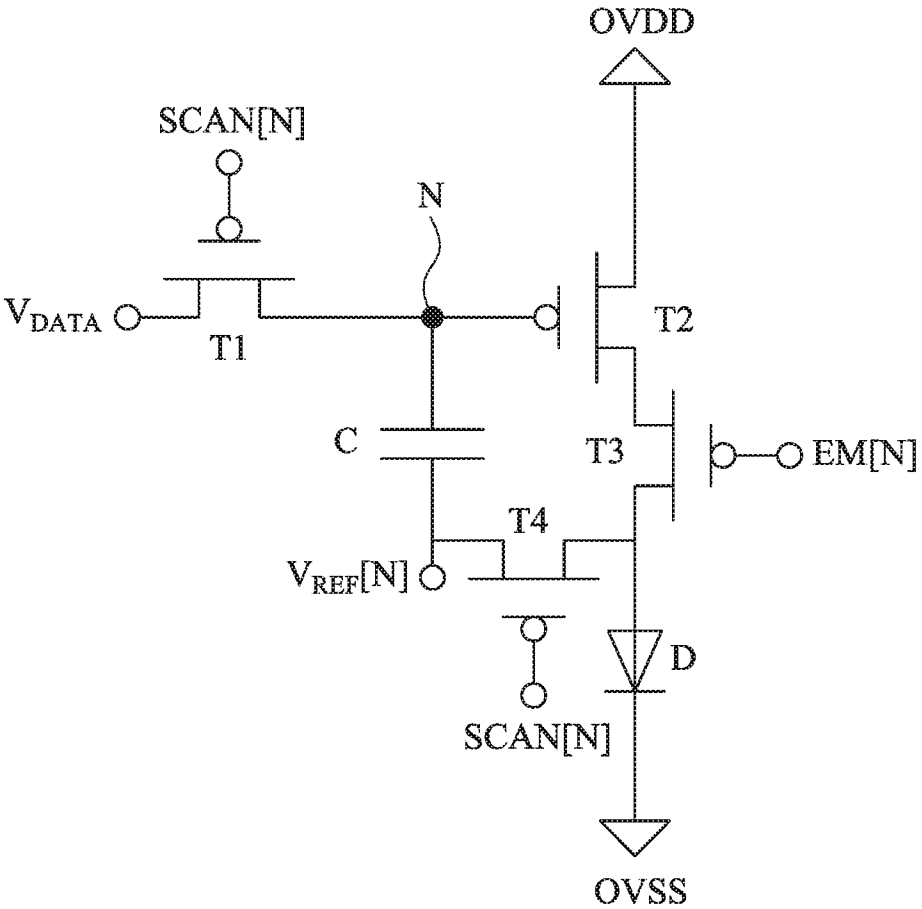
FIG. 6 is a schematic diagram of a pixel circuit according to an embodiment of the present disclosure.

FIG. 6 is a schematic diagram of a pixel circuit according to an embodiment of the present disclosure. The pixel circuit shown in FIG. 6 is compared to the pixel circuit shown in FIG. 1, the switch T4 of the pixel circuit of FIG. 6. is coupled between the LED D and the second terminal of the capacitor C. In an embodiment, referring to FIG. 2, in the first period P1, the scan signal SCAN[N] is a low level signal, the switch T4 is correspondingly turned on. The anode of the LED D is reset by the reference signal $V_{REF}$[N], in this embodiment, in the first period P1, the voltage of the reference signal $V_{REF}$[N] is not greater than the power supply voltage OVSS plus a turn-on voltage of the LED D. It should be noted that the components in FIG. 6 having the same reference numerals as those in FIG. 1 have corresponding operation modes. Therefore, the operation of the pixel circuit in FIG. 6 is not described herein except for the above differences.

Figure 7:
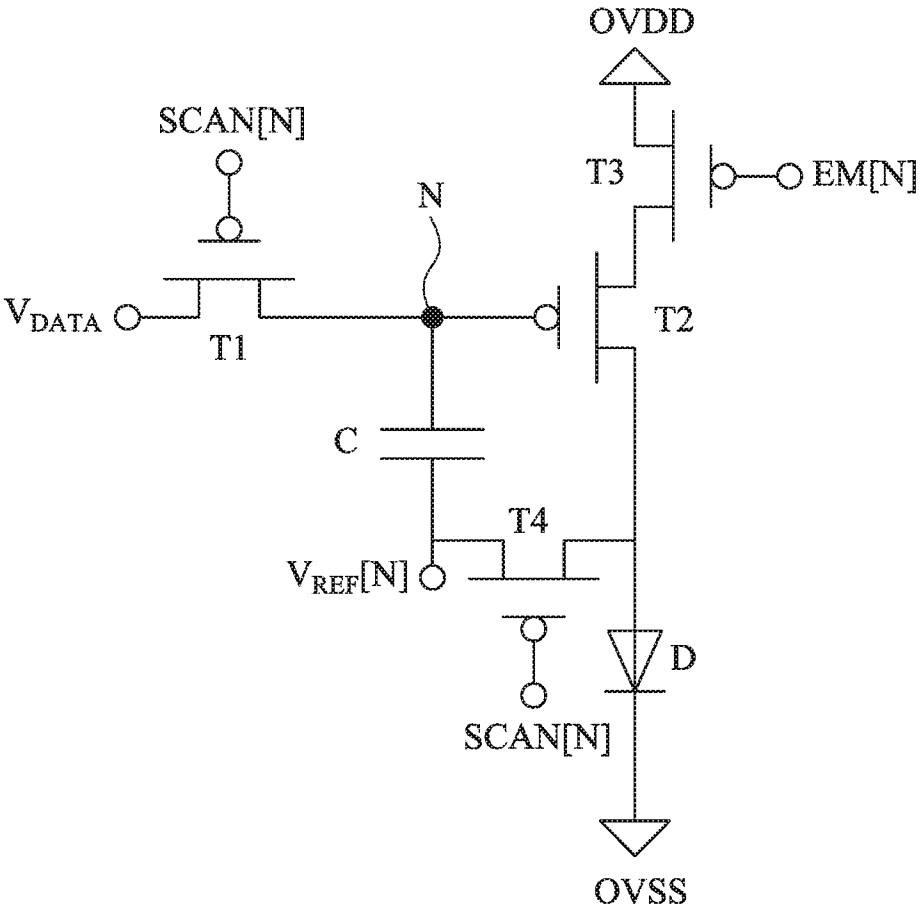
FIG. 7 is a schematic diagram of a pixel circuit according to an embodiment of the present disclosure.

FIG. 7 is a schematic diagram of a pixel circuit according to an embodiment of the present disclosure. The pixel circuit shown in FIG. 7 is compared to the pixel circuit shown in FIG. 6, one of the terminals of the switch T3 of the pixel circuit shown in FIG. 7 is configured to receive the power supply voltage OVDD, the other terminal of switch T3 is coupled to the driving transistor T2. The switch T3 is configured to determine whether to conduct a current path passing through the LED D. It should be noted that the components in FIG. 7 having the same reference numerals as those in FIG. 6 have corresponding operation modes. Therefore, the operation of the pixel circuit in FIG. 7 is not described herein except for the above differences.

Figure 8:
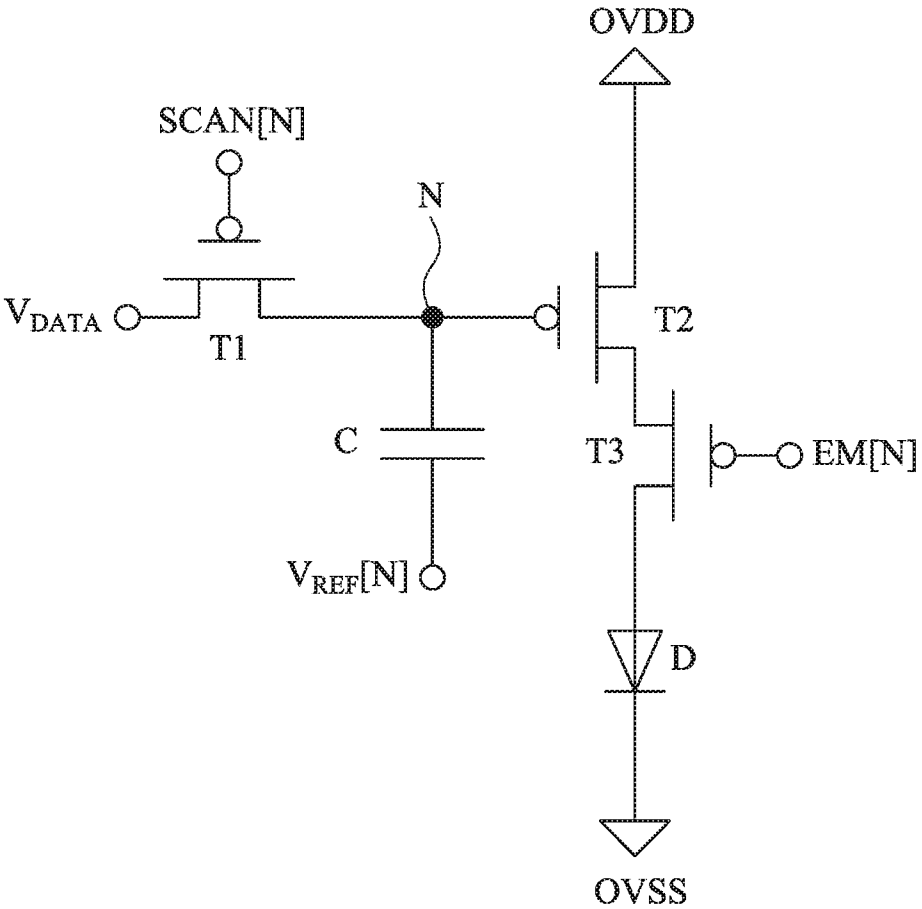
FIG. 8 is a schematic diagram of a pixel circuit according to an embodiment of the present disclosure.

FIG. 8 is a schematic diagram of a pixel circuit according to an embodiment of the present disclosure. The pixel circuit shown in FIG. 8 is compared to the pixel circuit shown in FIG. 1, the pixel circuit shown in FIG. 8 can also reset the anode terminal of the LED D without switching T4. It should be noted that the components in FIG. 8 having the same reference numerals as those in FIG. 1 have corresponding operation modes. Therefore, the operation of the pixel circuit in FIG. 8 is not described herein except for the above differences.

Figure 9:
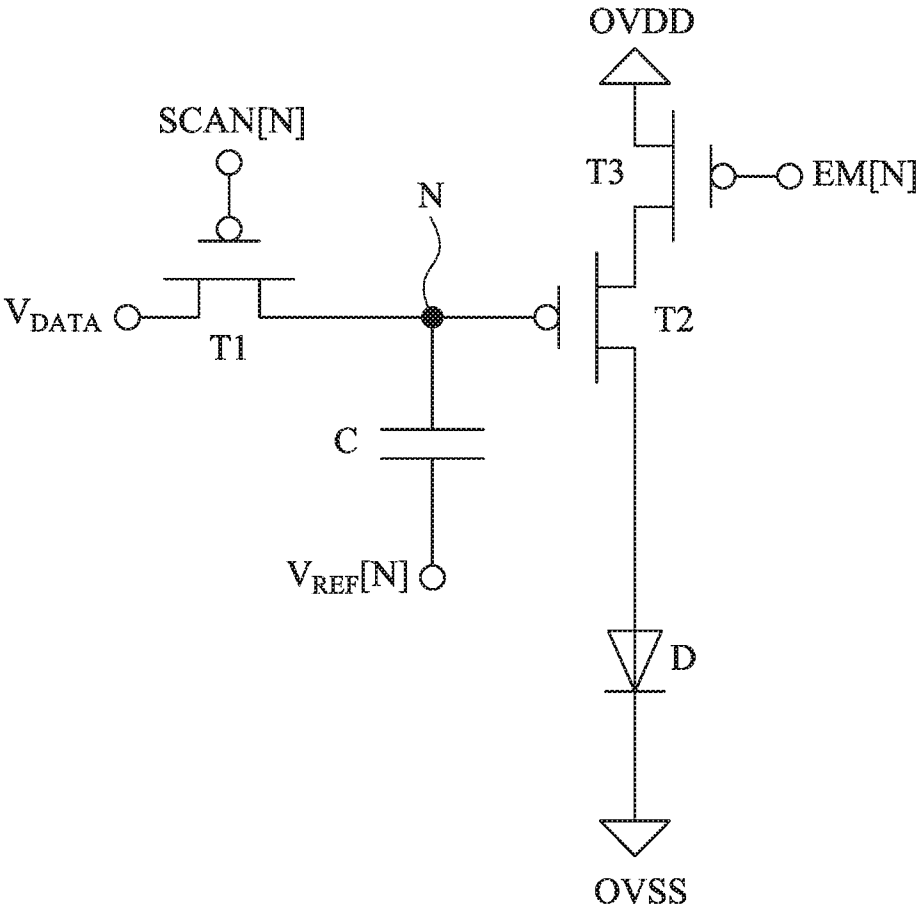
FIG. 9 is a schematic diagram of a pixel circuit according to an embodiment of the present disclosure.

FIG. 9 is a schematic diagram of a pixel circuit according to an embodiment of the present disclosure. The pixel circuit shown in FIG. 9 is compared to the pixel circuit shown in FIG. 8, one of the terminals of the switch T3 of the pixel circuit shown in FIG. 7 is configured to receive the power supply voltage OVDD, the other terminal of switch T3 is coupled to the driving transistor T2. The switch T3 is configured to determine whether to conduct the current path passing through the LED D. It should be noted that the components in FIG. 9 having the same reference numerals as those in FIG. 8 have corresponding operation modes. Therefore, the operation of the pixel circuit in FIG. 9 is not described herein except for the above differences.

Figure 10:
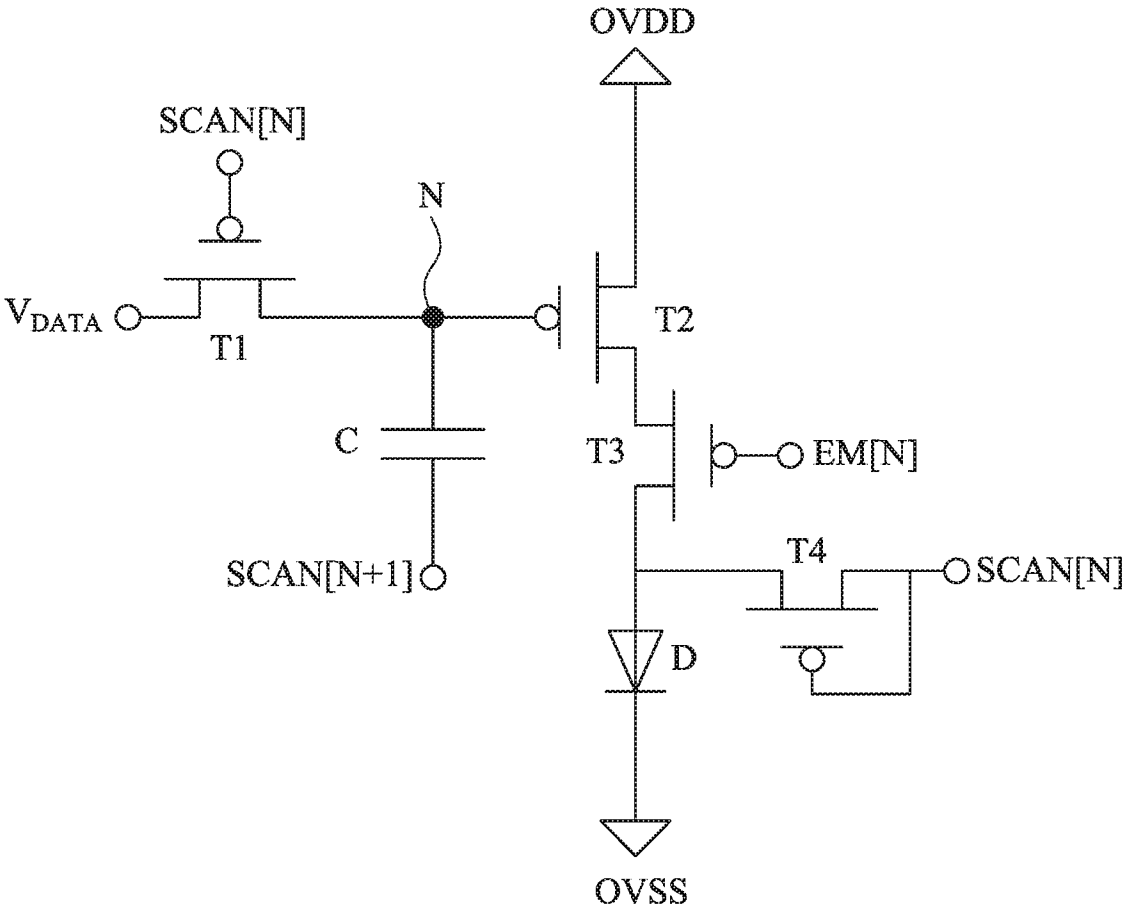
FIG. 10 is a schematic diagram of a pixel circuit according to an embodiment of the present disclosure.
Figure 12:
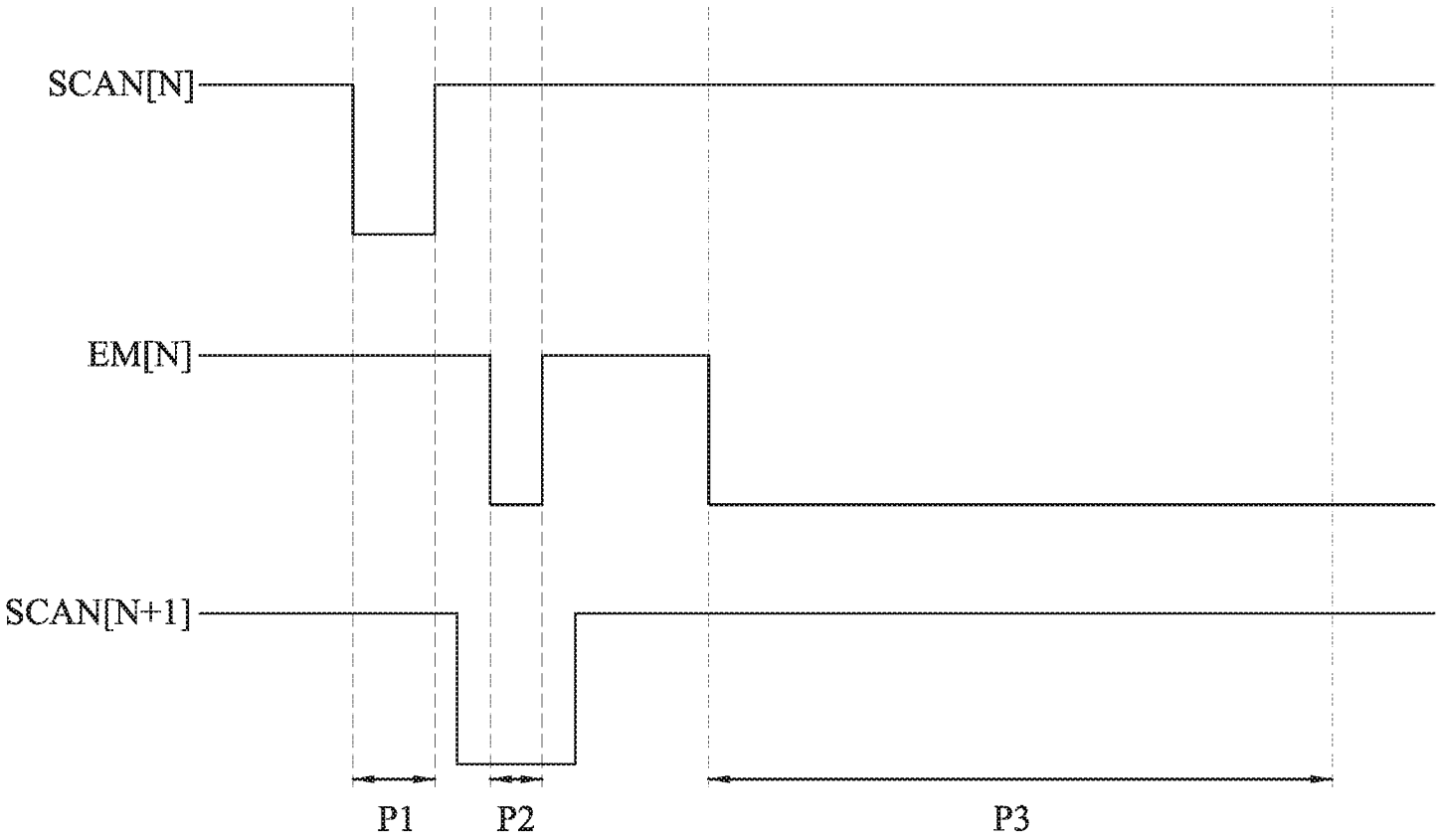
FIG. 12 is a waveform schematic diagram according to an embodiment of the present disclosure.

FIG. 10 is a schematic diagram of a pixel circuit according to an embodiment of the present disclosure. The pixel circuit shown in FIG. 10 is compared to the pixel circuit shown in FIG. 1, the signal received by the second terminal of the capacitor C of the pixel circuit of FIG. 10 is a next stage scan signal SCAN[N+1]. Referring to FIG. 2 and FIG. 12, both figures are the waveforms schematic diagrams according to an embodiment of the present disclosure. Since the waveform of the next stage scan signal SCAN[N+1] in FIG. 12 is similar to the waveform of the reference signal $V_{REF}$[N] in FIG. 2, therefore, the pixel circuit of FIG. 10 can be controlled by the next stage scan signal SCAN[N+1] in FIG. 12. The overall operation is similar to the pixel circuit shown in FIG. 1, using the next stage scan signal SCAN [N+1] for control, only need to apply the next stage scan line of a gate driver (not shown), and no additional reference signal line is needed to provide the above reference signal VREF [N]. In this way, the volume of the overall display device (not shown) applied to the pixel circuit of the present disclosure can be saved.

Figure 11:
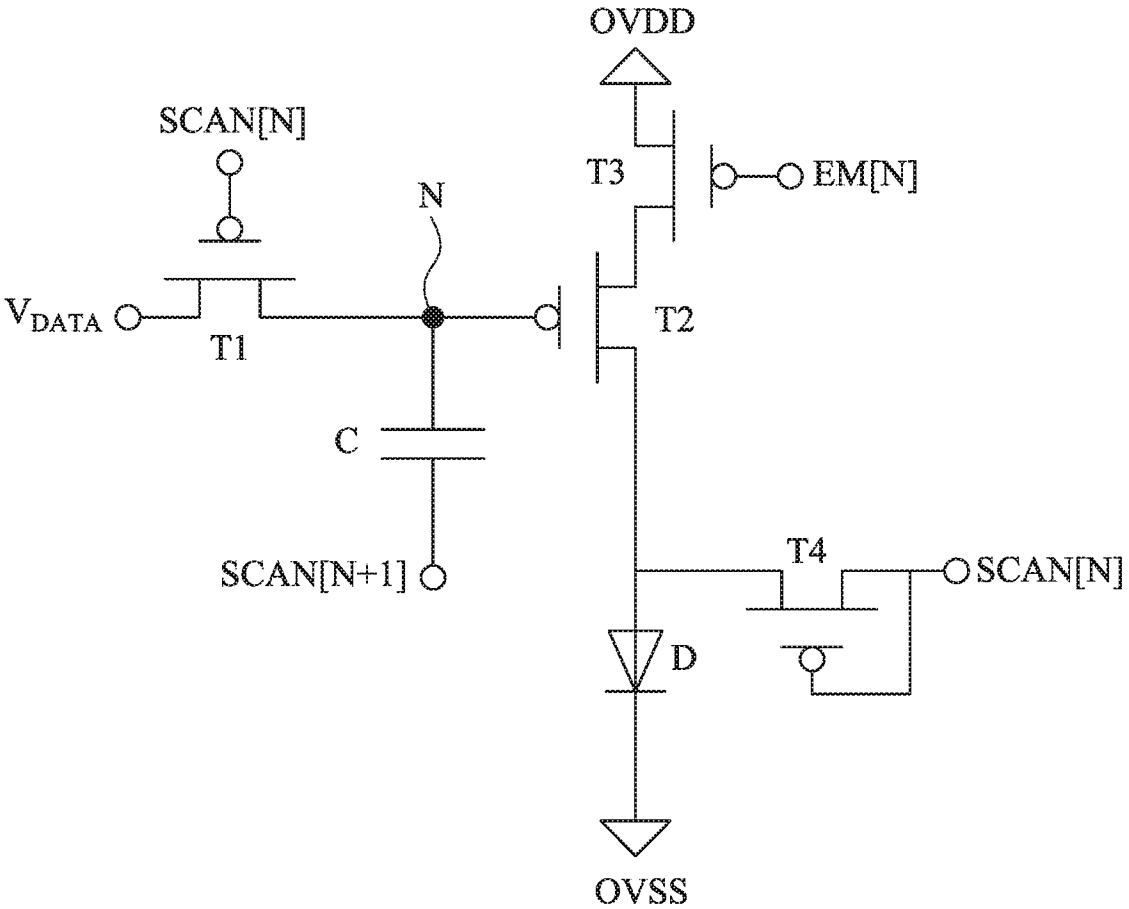
FIG. 11 is a schematic diagram of a pixel circuit according to an embodiment of the present disclosure.

FIG. 11 is a schematic diagram of a pixel circuit according to an embodiment of the present disclosure. The pixel circuit shown in FIG. 11 is compared to the pixel circuit shown in FIG. 10, one of the terminals of the switch T3 of the pixel circuit shown in FIG. 11 is configured to receive the power supply voltage OVDD, the other terminal of switch T3 is coupled to the driving transistor T2. It should be noted that the components in FIG. 11 having the same reference numerals as those in FIG. 10 have corresponding operation modes. Therefore, the operation of the pixel circuit in FIG. 11 is not described herein except for the above differences.

It can be seen from the above embodiments of the present disclosure that the application of the present disclosure has the following advantages. The embodiment of the present disclosure provides a pixel circuit for providing different current magnitudes through adjustment of reference signal under the same data voltage. When the pixel circuit provides a large current by the above technical features, the response time can be improved, and the field of the pixel circuit application of the present disclosure is wider. When the pixel circuit provides a small current by the above technical features, the display can be uninterrupted and the phenomenon of display flicker can be reduced.

Reference will now be made in detail to the present embodiments of the disclosure, examples of which are illustrated in the accompanying drawings. It will be apparent to those skilled in the art that after understanding the embodiments of the present disclosure, various modifications and variations can be made based on the teaching of the disclosure without departing from the scope or spirit of the disclosure. Therefore, the scope of protection of the present disclosure is mainly based on the scope of the claims and its equal scope.

What is claimed is:

1. A pixel circuit, comprising:

a first switch having a first terminal configured to output a data voltage in response to a scan signal;

a capacitor, wherein the capacitor comprises:

a first terminal, wherein the first terminal of the capacitor and the first terminal of the first switch are connected together in a node; and a second terminal directly connected to a reference signal;

a driving transistor having a control terminal, wherein the control terminal of the driving transistor is directly connected to the node, wherein the driving transistor outputs a current according to a voltage of the node; and a light emitting diode (LED), coupled to the driving transistor, wherein the LED emits light according to the current;

wherein the data voltage is written to the node by the first switch, the reference signal is changed to different voltages during different operation periods, the capacitor couples a voltage difference between the different voltages to the node according to the reference signal, wherein the driving transistor outputs a first current respectively according to the data voltage and the voltage difference, and outputs a second current according to the data voltage during different operation periods, such that the LED emits a first brightness light according to the first current and emits a second brightness light according to the second current during different operation periods.

2. The pixel circuit of claim 1, wherein in a first period, the data voltage is written to the node by the first switch, and the reference voltage comprises a first voltage, wherein in a second period, the reference signal comprises a second voltage, the capacitor couples the voltage difference between the second voltage and the first voltage to the node, the driving transistor outputs the first current according to the data voltage and the voltage difference, such that the LED emits the first brightness light according to the first current.

3. The pixel circuit of claim 2, wherein in a third period, the reference signal comprises the first voltage, the driving transistor generates the second current according to the data voltage, such that the LED emits the second brightness light according to the second current.

4. The pixel circuit of claim 3, wherein the first voltage is greater the second voltage.

5. The pixel circuit of claim 4, wherein the first current is greater the second current.

6. The pixel circuit of claim 4, further comprising:

a second switch, coupled to the driving transistor, wherein the second switch outputs the first current to the LED in the second period and outputs the second current to the LED in the third period according to a control signal.

7. The pixel circuit of claim 6, wherein in the second period, a period during which the second switch is turned on partially overlaps a period during which the reference signal is the second voltage.

8. The pixel circuit of claim 6, further comprising:

a third switch, coupled to the LED, wherein the third switch resets a voltage of an anode terminal of the LED in the first period according to the scan signal.

9. The pixel circuit of claim 6, further comprising:

a third switch, coupled between the LED and the second terminal of the capacitor, wherein the third switch resets a voltage of an anode of the LED in the first period according to the scan signal and the reference voltage.

10. The pixel circuit of claim 1, wherein the scan signal comprises a present stage scan signal, and the reference signal comprises a next stage scan signal.

11. A pixel circuit, comprising:

a first switch having a first terminal;

a capacitor, wherein the capacitor comprises:

a first terminal, wherein the first terminal of the capacitor and the first terminal of the first switch are connected together in a node; and a second terminal directly connected to a reference signal;

a driving transistor having a control terminal, wherein the control terminal of the driving transistor is directly connected to the node, wherein the driving transistor outputs a current according to a voltage of the node; and a light emitting diode (LED), coupled to the driving transistor, wherein the LED emits light according to the current;

wherein in a first period, the first switch outputs a data voltage to the node in response to a scan signal, and the reference voltage comprises a first voltage, wherein in a second period, the reference signal comprises a second voltage, the driving transistor outputs a first current to the LED according to the voltage of the node, wherein in a third period, the reference signal comprises the first voltage, the driving transistor outputs a second current to the LED according to the voltage of the node.

12. The pixel circuit of claim 11, further comprising:

a second switch, coupled to the driving transistor, wherein the second switch outputs the first current to the LED in the second period and outputs the second current to the LED in the third period according to a control signal.

13. The pixel circuit of claim 11, further comprising:

a third switch, coupled to the LED, wherein the third switch resets a voltage of an anode of the LED according to the scan signal.

14. The pixel circuit of claim 11, further comprising:

a third switch, coupled between the LED and the second terminal of capacitor, wherein the third switch resets a voltage of an anode of the LED in the first period according to the scan signal and the reference voltage.

15. The pixel circuit of claim 11, wherein the scan signal comprises a present stage scan signal, and the reference signal comprises a next stage scan signal.

* * * * *